US010915067B2

(12) United States Patent
Buehler et al.

(10) Patent No.: US 10,915,067 B2
(45) Date of Patent: Feb. 9, 2021

(54) PUSH-PIECE WINDING DEVICE FOR WATCHES

(71) Applicant: Harry Winston SA, Plan-les-Ouates (CH)

(72) Inventors: Johnny Buehler, Luins (CH); Bernat Monferrer, St-Prex (CH)

(73) Assignee: Harry Winston SA, Plan-les-Ouates (CH)

( * ) Notice: Subject to any disclaimer, the term of this patent is extended or adjusted under 35 U.S.C. 154(b) by 511 days.

(21) Appl. No.: 15/920,791

(22) Filed: Mar. 14, 2018

(65) Prior Publication Data

US 2018/0267471 A1 Sep. 20, 2018

(30) Foreign Application Priority Data

Mar. 17, 2017 (EP) ..... 17161509

(51) Int. Cl.
*G04B 3/04* (2006.01)
*G04B 3/00* (2006.01)

(52) U.S. Cl.
CPC ..... *G04B 3/041* (2013.01); *G04B 3/001* (2013.01); *G04B 3/045* (2013.01); *G04B 3/046* (2013.01); *G04B 3/048* (2013.01)

(58) Field of Classification Search
None
See application file for complete search history.

(56) References Cited

U.S. PATENT DOCUMENTS

2004/0090869 A1 5/2004 Schmiedchen
2013/0044572 A1* 2/2013 Kaelin ..... G04B 3/001 368/190
2014/0056114 A1* 2/2014 Monferrer ..... G04B 27/002 368/192
2014/0355398 A1* 12/2014 Karapatis ..... G04B 23/026 368/243

(Continued)

FOREIGN PATENT DOCUMENTS

CH 12174 10/1896
CH 140164 A * 5/1930 ..... G04B 3/001

(Continued)

OTHER PUBLICATIONS

European Search Report dated Sep. 22, 2017, issued in European Application EP 17161509.9, filed Mar. 17, 2017 (with English Translation of Categories of Cited Documents).

*Primary Examiner* — Daniel P Wicklund
(74) *Attorney, Agent, or Firm* — Oblon, McClelland, Maier & Neustadt, L.L.P.

(57) ABSTRACT

A winding device on a structure of a movement or watch case, including a telescopic push-piece, independent of the control stem, driving a rack for winding a barrel, and including, between a pipe fixed to the case and an operating head, first elastic return device tending to move the head away from the pipe, this head being capable of occupying an angular, longitudinal locking position corresponding to a rest position, or an angular position of freedom allowing axial mobility, or a stop position wherein it has one degree of freedom, this rack, which is movable against second elastic return device, cooperates with a winding wheel set meshing with an intermediate rack actuated by a return spring of the second elastic return device.

14 Claims, 5 Drawing Sheets

(56) References Cited

U.S. PATENT DOCUMENTS

| | | | | |
|---|---|---|---|---|
| 2016/0274548 | A1* | 9/2016 | Goldmann | G04B 21/12 |
| 2018/0267470 | A1* | 9/2018 | Monferrer | G04B 27/04 |
| 2018/0267475 | A1* | 9/2018 | Monferrer | G04B 27/04 |

FOREIGN PATENT DOCUMENTS

| | | | |
|---|---|---|---|
| CH | 710 271 | A2 | 4/2016 |
| FR | 1.269.569 | | 8/1961 |
| FR | 2 993 062 | | 1/2014 |
| WO | WO 02/077724 | A2 | 10/2002 |

* cited by examiner

PUSH-PIECE WINDING DEVICE FOR WATCHES

This application claims priority from European patent application No. 17161509.9 filed on Mar. 17, 2017, the entire disclosure of which is hereby incorporated herein by reference.

FIELD OF THE INVENTION

The invention concerns a winding device arranged to be secured to a watch structure comprising a case containing at least one barrel, a stem for controlling at least the hand-setting function that is movable with respect to said case, said winding device comprising a retractable bayonet push-piece which is telescopically extendable and comprises, between a pipe arranged to be fixed to said case and a user-actuatable head which carries a control member, first elastic return means tending to move said head away from said pipe, said head being movable in translation with respect to the longitudinal axis of said pipe, between two extreme end positions, which are a stop position, wherein said head is as close as possible to said case, and in which stop position said head has one rotational degree of freedom with respect to the longitudinal axis of said pipe, and an activated position which is a position of maximum elongation, more easily accessible to the user, and wherein said head is indexed in rotation with respect to said case in an indexed angular position, said head being capable of occupying, between said two stop and activated positions, a rest position wherein said head is capable of being immobilised longitudinally with respect to said pipe, in at least one angular locking position which is different from said indexed angular position, said push-piece, which is independent of said stem, being dedicated exclusively to the winding function and being arranged to indirectly drive at least the drum of a said barrel or a ratchet-wheel in order to wind a said barrel, said control member being movable linearly and arranged, upon a user action, for driving at least one movable rack against second elastic return means.

The invention also concerns a timepiece movement including a said structure to which at least one such winding device is fixed.

The invention also concerns a watch including such a winding device.

The invention concerns the field of energy charging mechanisms for watches.

BACKGROUND OF THE INVENTION

The manual winding of watches, especially mechanical watches, is always a concern of manufacturers, because of stresses imparted to the stem, and wear of the components. In particular, it is inconvenient to wind watches of small dimensions by means of the winding-crown, which is often inaccessible and extremely small.

It is therefore difficult for the user to properly transmit high torques and forces with winding-buttons and pushers of very small diameter, which are sometimes difficult to access, especially in ladies' watches, where accessibility may be further complicated by the length of the user's nails.

Other mechanisms have been made, especially by Léon Hatot, who, for ladies' watches, created sliding shutters covering the winding-crown, and the opening of which produced a power charge.

At the same time, such mechanisms make it difficult to provide a large power reserve, due to the large number of cycles that must be performed to completely wind the watch. For example, it is not unusual to require more than 20 turns of the stem to completely wind a small ladies' watch comprising a single barrel. The gear ratio must often be decreased, in order to reduce the torque to be applied to the winding button. Further, the space available means that is is not always possible to house an automatic winding mechanism.

FR Patent Application No 1269569A in the name of GLOBO discloses a control member, comprising a body fixed to a casing, and a push-piece axially movable inside said body, between a rest position and an active position. The push-piece can rotate inside the body, at least when it occupies a determined axial position with respect to the body. The push-piece and the body have locking members that naturally move into mesh with each other to hold the push-piece in the active position when it has been rotated with respect to the body, from the angular position that it occupies in the rest position. The push-piece is subjected to the action of a return spring that tends to hold it in the rest position, and the locking members form a bayonet coupling device. The body is formed by a sleeve, and the push-piece by a stem carrying a hollow control button that has an outer wall surrounding the open end of the sleeve. One of the elements of the bayonet coupling device is formed by an L-shaped indentation in the sleeve, and the other of these elements by a pin protruding into the wall of the control button, and penetrating said indentation. In a variant, the body has an inner rim with a shaped opening for passage of the push-piece, the latter having a portion of corresponding shape to that of the opening, this portion of the push-piece being engaged in the opening when the push-piece is at rest, and being located under the rim when the push-piece is in the active position, the rim of the body and the corresponding push-piece portion forming the locking members. In another variant the locking members are formed by corresponding internal and external threads, which are remote from each other when the push-piece is in the rest position and engage with one another at the moment that the push-piece is moved into the active position, the push-piece having threads permanently engaged in corresponding threads of the body.

Patent Application No CH710271A2 in the name of MONTRES BREGUET SA discloses a telescopic control member for stopping and/or stopping a watch function, comprising a fixed body driven into an opening in a case, and inside which slides a push button. The control member comprises elastic return means, an axially movable stem configured to cooperate with a control mechanism, and a winding-crown fixed to the stem by telescopic means. The telescopic means comprise an intermediate element integral with the winding-crown, the intermediate element being configured to be guided on the stem and arranged to be integral with the stem in at least two axial positions, such that the control member can move from a retracted position, wherein the control member is disabled, to a deployed position, or 'operating position', wherein the control member is capable of starting and/or stopping the function.

Patent Application No WO02/077724A2 in the name of GLASHUETTER UHRENBETRIEB GmbH discloses a striking device actuated by a barrel with a mainspring independent of the watch movement. The watch comprises manually actuatable mechanical control means for releasing the striking device. The barrel is wound by a winding bar, the free end of which ends in a toothed segment, and which is kinematically connected to a winding push-piece on the one hand, and to the mainspring of the striking mechanism on the other hand.

Patent No CH 12174 in the name of STAUFFER discloses a mechanism for winding the striking barrel in repeater watches, actuated by the crown which moves on a cylindrical pendant, parallel to its axis.

Patent Application No FR2993062A1 in the name of CHEVAL FRERES discloses a watch winding-crown associated, in axial and rotation displacement, with a threaded arbor traversing a case, through a tube fixed on the latter, and connected, at one of the ends thereof opposite to the winding-crown, to a stem of a mechanism for driving the various watch functions. The winding-crown is housed inside an external lateral recess in the case, of substantially corresponding shape, into which it can retract or from which it can be removed by telescopic translation means automatically actuated by a manual pulse release device, housed inside a housing of the winding-crown.

SUMMARY OF THE INVENTION

The invention proposes to define a winding mechanism that is easier to use than an ordinary winding-crown, especially for watches of small dimensions, such as ladies' watches, and can completely wind a watch with a reduced number of winding cycles.

To this end, the invention concerns a winding device according to claim 1.

The invention also concerns a timepiece movement comprising a said structure on which at least one such winding device is fixed.

The invention also concerns a watch comprising such a winding device, or such a movement.

BRIEF DESCRIPTION OF THE DRAWINGS

Other features and advantages of the invention will appear upon reading the following detailed description, with reference to the annexed drawings, in which.

DETAILED DESCRIPTION OF PREFERRED EMBODIMENTS

Figure 1:
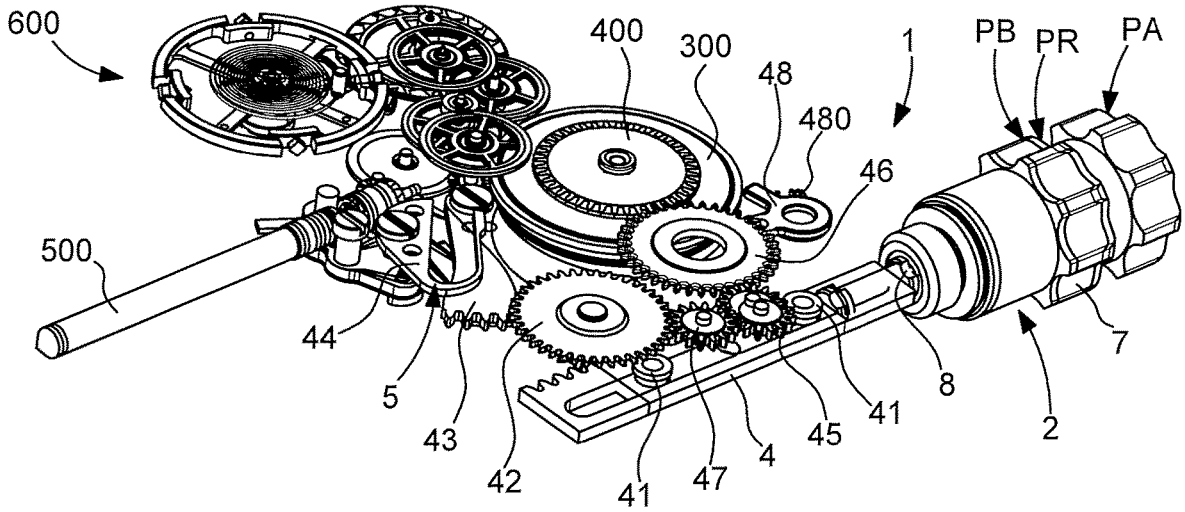
FIG. 1 represents a schematic, perspective, bottom view of a timepiece movement comprising a winding device according to the invention, arranged for winding a barrel, with a push-piece represented in its three notable positions: rest, activated and stop.
Figure 2:
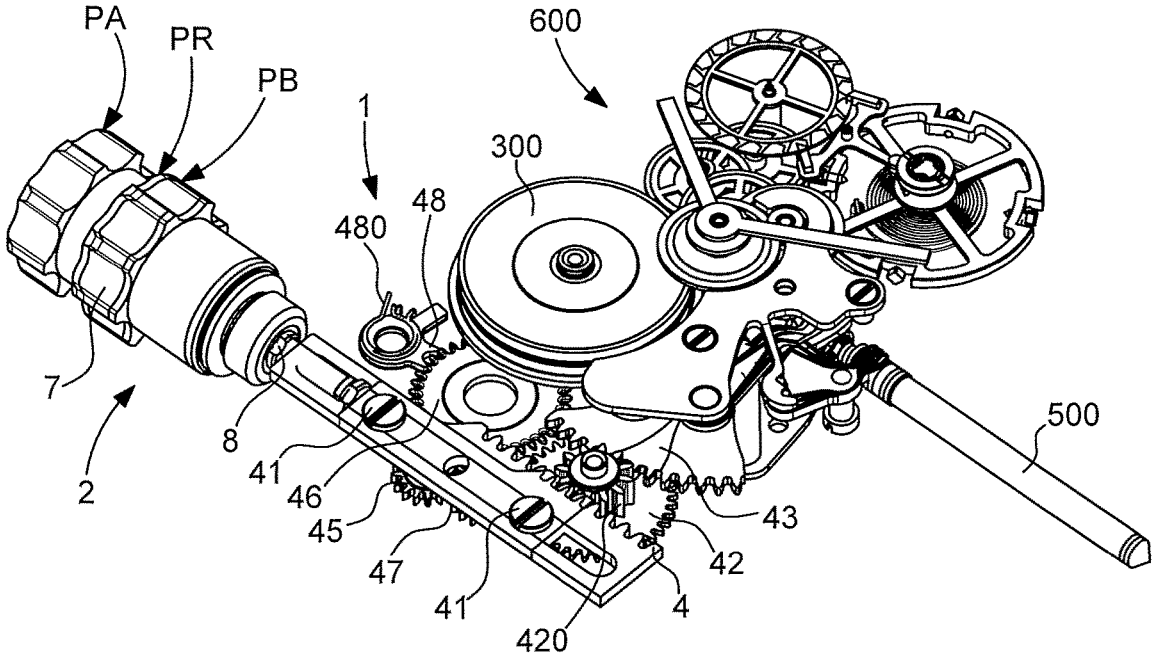
FIG. 2 represents a schematic and perspective top view of the movement of FIG. 1.
Figure 3:
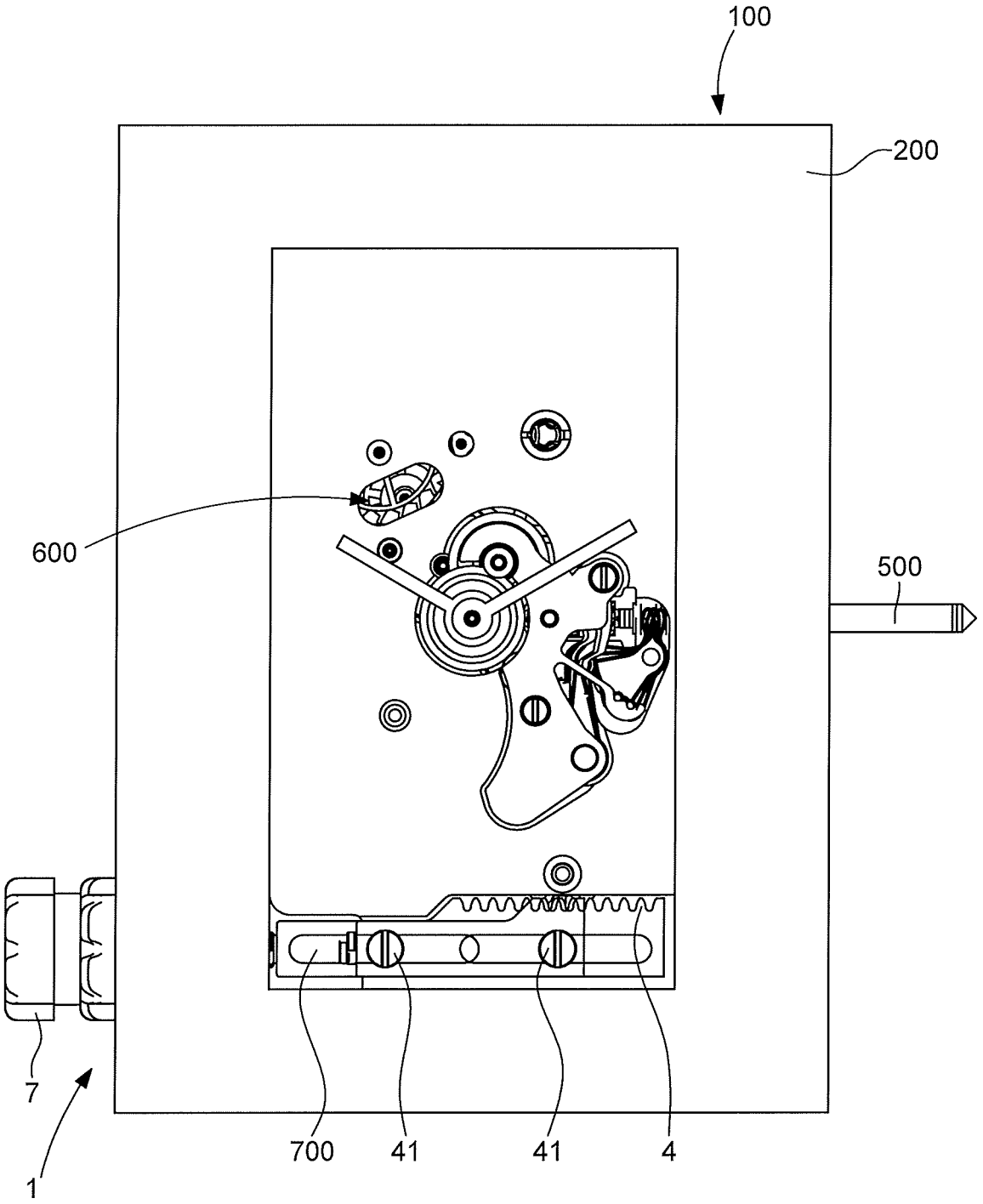
FIG. 3 shows a schematic top view of a watch comprising a case containing the movement of FIG. 1.
Figure 5:
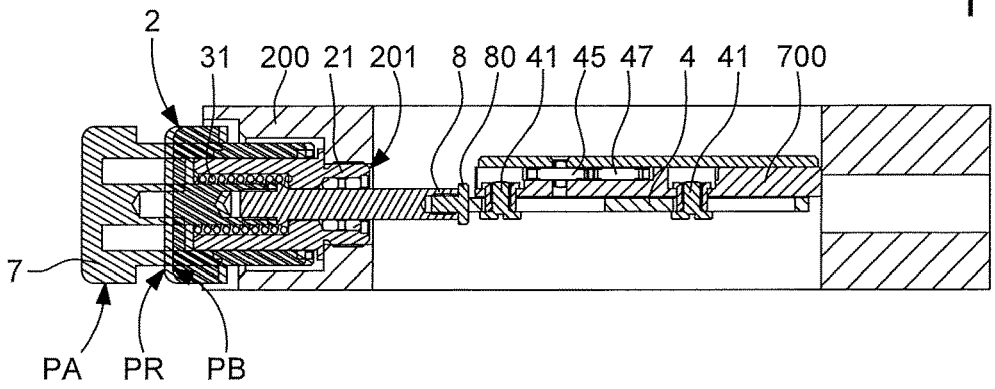
FIG. 5 represents a schematic view of the same watch in cross-section along section A-A of FIG. 4.
Figure 4:
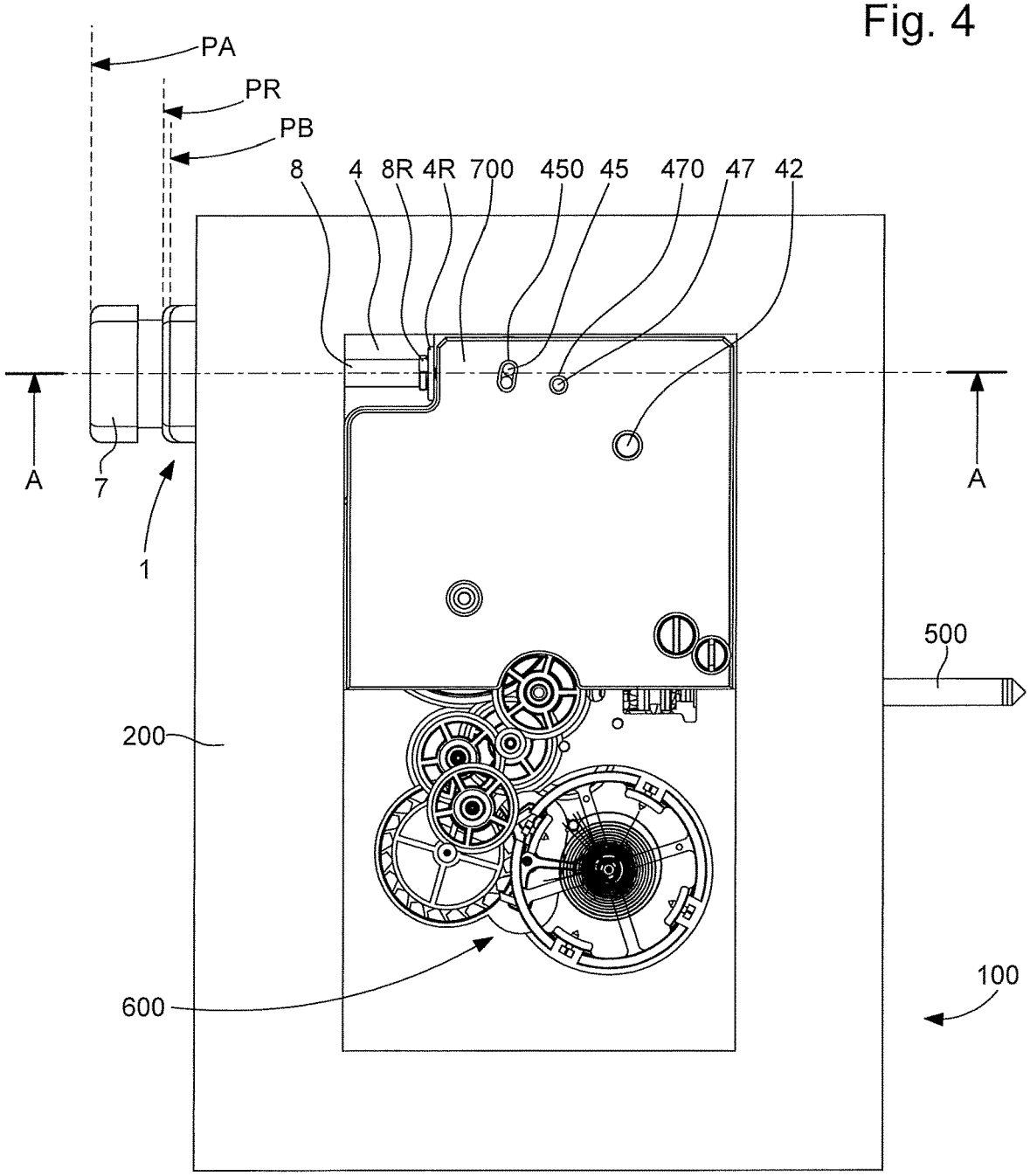
FIG. 4 represents a schematic, bottom view of the watch of FIG. 3.
Figure 6:
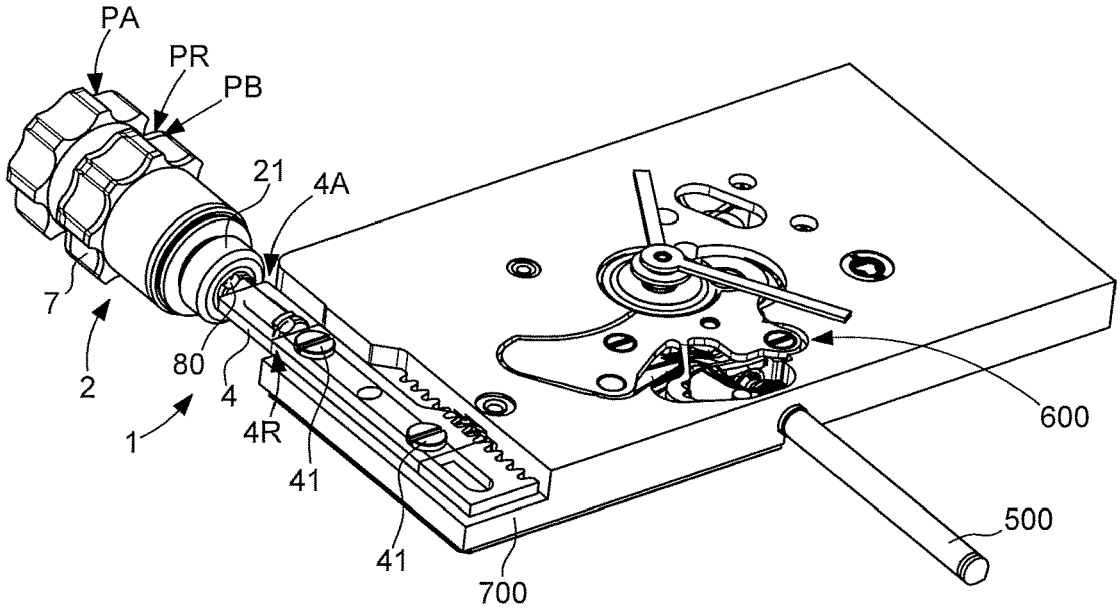
FIG. 6 represents a schematic, perspective, top view of a portion of the watch of FIG. 3, with a structure that carries the winding device according to the invention.

The invention concerns a winding device 1 pour a watch 100, especially a mechanical watch. Such a watch 100 comprises, in a conventional manner, a case 200 containing at least one barrel 300, in particular provided with a ratchet-wheel 400, and a stem 500, movable with respect to said case, for controlling at least the time-setting function.

Winding device 1 is arranged to be secured to a structure 700 of a watch 100, said structure 700 may be a plate or a bridge, or suchlike, of a movement 600, intended to be incorporated in watch 100, or case 200 itself, or a member comprised therein, such as the case middle, back cover or suchlike.

Winding device 1 according to the invention is multipurpose, since it can form a main winding device, or an additional winding device, in particular in the case where the watch also comprises an automatic winding device. This winding device 1 may power a main barrel intended to wind a movement 600, or a secondary barrel for a secondary function, such as a chronograph or a striking mechanism, an automaton, or suchlike. Naturally, winding device 1 can also be arranged for driving a plurality of ratchets, each connected to a different barrel.

The invention is illustrated by the Figures in the particular and non-limiting case of driving a main barrel.

This winding device 1 comprises a push-piece 2, which is arranged for indirectly driving at least one ratchet-wheel 400 to wind a barrel 300, or for indirectly driving the drum of barrel 300.

This push-piece 2 is a retractable push-piece with a bayonet coupling, extendable telescopically and comprises, between a pipe 21 arranged to be secured to a case 200 and a user-actuatable head 7, which comprises a control member 8, first elastic control means 6 tending to move head 7 away from pipe 21.

This head 7 is movable in translation with respect to the longitudinal axis of pipe 21, between two extreme end positions, which are a stop position PB, wherein head 7 is as close as possible to case 200, and in which stop position PB head 7 has one rotational degree of freedom with respect to the longitudinal axis of pipe 21, and an activated position PA which is a position of maximum elongation, more easily accessible to the user, and wherein head 7 is indexed in rotation with respect to case 200 in an indexed angular position, this head 7 being capable of occupying, between the two stop and activated positions PB and PA, a rest position PR, wherein head 7 is capable of being immobilised longitudinally with respect to pipe 21, in at least one angular locking position which is different from the indexed angular position. More particularly, this pipe 21 comprises a first bore 22 for guiding an arbor 81 which is fixed to head 7 and which forms control member 8, for pushing, in particular but not exclusively, in translation, a rack 4 or a moving timepiece component.

This push-piece 2 is linearly movable and arranged, upon a user action, to drive, particularly in translation as in the particular case illustrated by the Figures, at least one rack 4. It is understood that rack 4 may have a travel that is not linear, particularly a circular travel, for example following the contour of the movement, if the latter is round, or of other shape. In the non-limiting example of the Figures, rack 4 is guided on two supports 41; this configuration is also suitable for a circular travel of rack 4.

According to the invention, push-piece 2 is used exclusively for the winding function and is independent of stem 500.

Naturally, this does not preclude stem 500 from having the conventional function of winding an energy storage element of the watch, particularly a barrel.

It is to be understood that push-piece 2 does not use any trains in relation to stem 500, and is independent, for directly actuating rotation of a ratchet-wheel.

This push-piece 2 is telescopically extendable, and comprises, between a pipe 21 arranged to be fixed to case 200 and a user-actuatable head 7 which carries control member 8, first elastic return means 6 which tend to move head 7 away from pipe 21.

Head 7 is movable, in a limited manner, in rotation and in translation, with respect to the longitudinal axis of pipe 21.

Head 7 is movable in translation with respect to the longitudinal axis of pipe 21 between two extreme end positions: a stop position PB, wherein head 7 is as close as possible to case 200, for example in a recess, in which stop position PB head 7 has one rotational degree of freedom with respect to the longitudinal axis of the pipe, and an activated position PA, which is a position of maximum elongation, wherein it is more easily accessible to the user, and wherein it is indexed in rotation with respect to case 200 in an indexed angular position. Between the two stop and activated positions PB and PA, head 7 can occupy a rest position wherein it is immobilised longitudinally with respect to pipe 21, in at least one angular locking position, which is different from the indexed angular position.

It is clear that stop position PB is a transitory position, which is used only for changing the angular position of head 7 with respect to pipe 21: from the indexed angular position to the locking angular position, or vice versa. It is in this stop position PB that the user imparts to head 7 the rotation that enables it to change angular position, by 45° in the particular, non-limiting example of the Figures.

In some of the Figures the display of these three positions is superposed, the numerical references are thus in some cases assigned the letter B stop, A activated or R rest, to better distinguish them.

According to the invention, rack 4 is movable against second elastic return means 5, which are arranged to oppose a force resisting the thrust of rack 4, and to return said rack to the start-of-travel position each time that the user releases push-piece 2, and more particularly, this at least one rack 4 is slidably mounted, and is linearly guided by guide means, or by at least two supports 41 in the non-limiting illustrated example, and cooperates with a winding wheel set 42 which meshes with an intermediate rack 43. This intermediate rack 43 is actuated by at least one return spring 44 comprised in second elastic return means 5.

More particularly, winding wheel set 42 meshes with a sliding intermediate wheel 45 which, depending on its direction of rotation, meshes or does not mesh, either directly with ratchet-wheel 400, or, as illustrated in the Figures, with a transmission wheel 46 that in turn meshes with ratchet-wheel 400, to wind the barrel 300 associated with ratchet-wheel 400, as a result of actuation of push-piece 2.

It is understood that, by selecting the gear ratios between winding wheel set 42, sliding intermediate wheel 45, and transmission wheel 46, it is possible to adjust the number of cycles required to completely wind the barrel, or to increase the torque transmitted in each winding cycle by pushing push-piece 2 to its end position of travel.

More particularly, winding wheel set 42 meshes with a sliding intermediate wheel 45 via at least one reverser pinion 47, according to the position of push-piece 2 in case 200, and the direction of rotation of the barrel(s). Naturally, it is possible, if necessary, to insert a longer train between winding wheel set 42 and sliding intermediate wheel 45, with as many intermediate wheels and reversers as required.

In the non-limiting illustrated case, which concerns a ladies' watch calibre of very small size, the ratio is only between winding wheel set 42 and ratchet-wheel 400, in fact it is easy to adapt the dimensioning of winding wheel set 42 according to the desired ratio. More particularly, sliding intermediate wheel 45, any reverser pinion 47, and transmission wheel 46, act as an intermediate wheel, with a ratio of 1; naturally, it is possible to modify this ratio with wheels and pinions, but to the detriment of space.

It is understood that the presence of transmission wheel 46 and/or reverser pinion 47 is made necessary by the relative positioning between barrel 300 and winding device 1 according to the invention, not only in terms of the space between them, but also according to their relative angular positioning with respect to the watch case, the direction of rotation of barrel 300 as it unwinds being set by the direction of operation of the train of timepiece movement 600 to which barrel 300 supplies energy.

More particularly, winding device 1 comprises a third elastic return means, or an anti-reverse click 48 provided with a spring 480 or a jumper spring or similar, to prevent the barrel unwinding, and cooperating with transmission wheel 46 or with ratchet-wheel 400. Sliding intermediate wheel 45 can thus easily disengage from transmission wheel 46 without being subjected to opposite tension.

In the illustrated embodiment, this click 48 is on transmission wheel 46, rather than on ratchet-wheel 400, to optimise space, due to a thin movement configuration, which precludes placing the click on the ratchet-wheel, or a jumper spring having the same function, as may be the case in a larger calibre.

In the illustrated embodiment, on the outward travel (pushing of rack 4), the sliding intermediate wheel engages, on the return travel the sliding intermediate wheel disengages. This configuration is preferred to the reverse configuration, which would require unnecessarily excessive dimensions for the return spring of rack 4.

More particularly, and as seen in the embodiment illustrated by the Figures, the first linear travel of head 7 is parallel to the second linear travel of rack 4.

In another variant that is not illustrated, the first linear travel of head 7 is not parallel to the second linear travel of rack 4, and control member 8 cooperates with a rack 4 via an articulated connection, for example with an intermediate arm comprising a first articulation with control member 8, and a second articulation with rack 4, or suchlike. These articulations can be achieved in a conventional manner by articulation pins, or the articulated connection is achieved using a component made of micromachinable material, such as silicon or suchlike, comprising a plurality of neck portions forming as many articulations, this component being inserted between rack 4 and control member 8, or integral with rack 4, with which it may also be made in one piece. In yet another variant, the thrust connection between control member 8 and rack 4 is achieved by sloped surfaces forming wedges.

More particularly, in an advantageous embodiment illustrated by the Figures, push-piece 2 is a retractable bayonet push-piece, and comprises a pipe 21 arranged to be screwed and/or bonded in a chamber 201 of case 200. This pipe 21 which includes a first bore 22 for guiding an arbor 81 that is fixed to head 7, for example by an external thread 29 and an internal thread 79, or suchlike, and which forms control member 8 for driving, particularly in translation, the at least one rack 4. More particularly, at least one gasket 92 is inserted between first bore 22 and arbor 81, to ensure the sealing of the interior of case 200.

Figure 9:
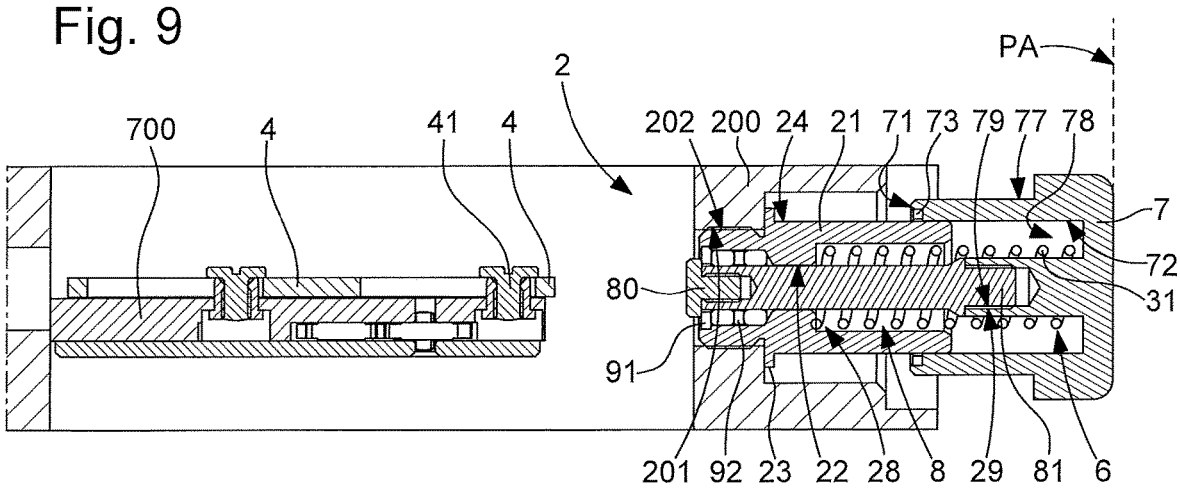
FIGS. 9, 10 and 11 schematically represent in a longitudinal cross-section with respect to the axis of push-piece, the push-piece module, respectively in an activated, rest and stop position.
Figure 10:
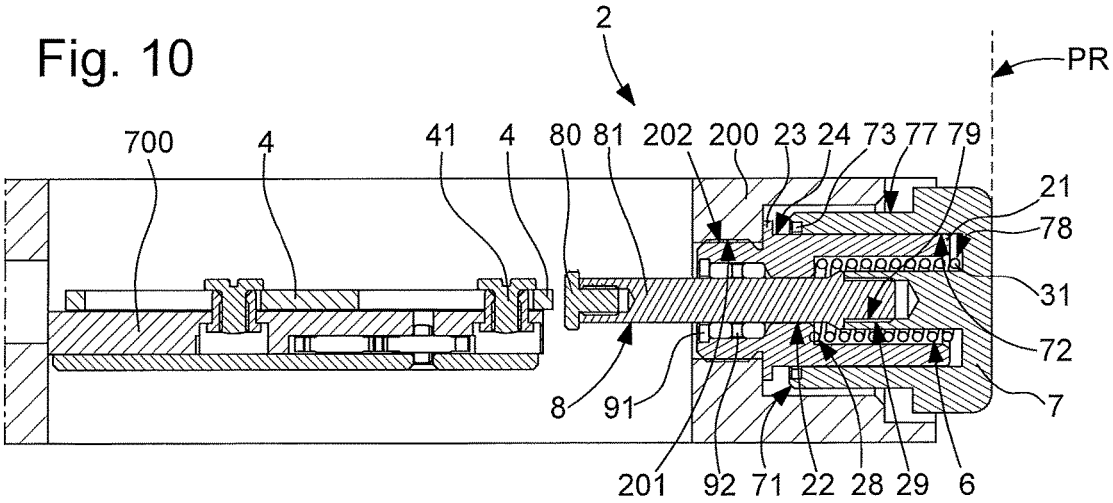
Figure 11:
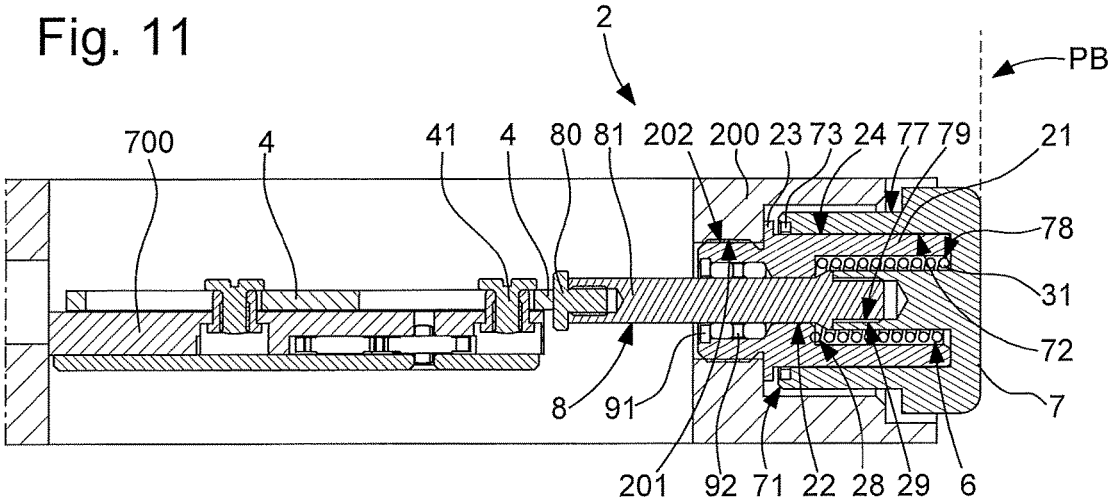

In the non-limiting illustrated embodiment, arbor 81 comprises, at its end, a screw 80 that comprises a smooth front surface, more particularly a flat surface, free of slots, which is driven by a peripheral profile, to avoid catching rack 4 when push-piece 2 rotates about its longitudinal axis. This screw 80 also advantageously serves as a rear stop to prevent removal of arbor 81, as seen, in particular, in FIG. 9 wherein the head of screw 80 comes to bear on an end stop 91, which may be a mechanical stop, such as snap ring, slit ring or suchlike, or a gasket.

Figure 7:
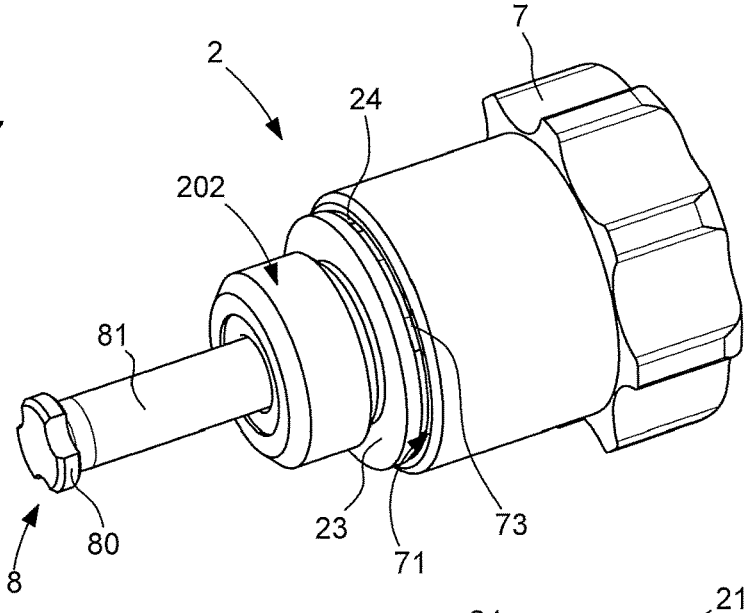
FIG. 7 represents a schematic, perspective view of the push-piece of the winding device according to the invention, forming an independent module.
Figure 8:
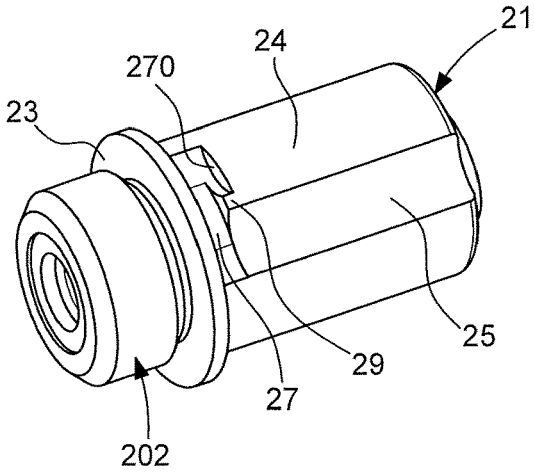
FIG. 8 represents, in a similar manner, the pipe comprised in the push-piece.

More particularly, and as seen in FIG. 7, push-piece 2 forms an independent module arranged to push a rack 4, and which can be inserted in one unit into chamber 201 of case 200 of a watch 100. Preferably, but not exclusively, pipe 21 is inserted in a permanent manner, by screws and/or adhesive bonding or similar.

More particularly, pipe 21 comprises, adjacent to a thrust collar 23 which is intended to bear on a face of case 200, a cylindrical shoulder 24, on which slides a bore 72 of head 7. At least one longitudinal slot 25 parallel to the axis of pipe 21 is provided at the periphery of this cylindrical shoulder 24, as seen in FIG. 7. A lug 73, which is integral with a front end 71 of head 7, slides into this longitudinal slot 25 during a relative translation between head 7 and pipe 21, in a particular angular position of head 7, which is an angular position of freedom.

This at least one longitudinal slot 25 leads, in proximity to collar 23, to a recess 27 forming a bayonet profile capable of receiving lug 73 upon suitable rotation of head 7 with respect to pipe 21, to form an axial stop for head 7 with respect to pipe 21, head 7 is then in angular locking position. The direction of rotation is unimportant and is selected when the ergonomics of the product are defined.

More particularly, pipe 21 comprises a first chamber 28 aligned with a second chamber 78 comprised in head 7 for receiving a spring 31 that tends to move head 7 away from pipe 21, spring 31 forming the first elastic return means 6.

More particularly, recess 27 comprises a housing 270 arranged to house lug 73 in a rest position, and which is separated from longitudinal slot 25 by a peripheral stop 29 prohibiting any rotation of head 7 when lug 73 is housed inside housing 270 in the absence of axial movement by head 7. Head 7 is then in the rest position referenced PR in the Figures, and in the angular locking position, and, to release it therefrom in order to perform winding, it is necessary to exert pressure on head 7 tending to move it closer to collar 23 of pipe 21, up to stop position PB, which is a transitory position and which is sufficiently far to provide clearance between lug 73 and peripheral stop 29, the user cannot push head 7 further. The user can then impart to head 7 a rotation that moves it into the indexed angular position, which allows longitudinal freedom, spring 31 then pushes head 7 towards active position PA, wherein spring 31 is its most relaxed position, and from which the user can operate head 7 and wind the barrel via a certain number of successive presses. This rotation is by 45° in the non-limiting example of the Figures.

Preferably, only a knurled or similar end of head 7, and an external shoulder 77, protrude from case 200, the mechanism of push-piece 2 thus remains concealed, and protected, inside case 200 at any time.

In the particular case illustrated by the Figures, pipe 21 comprises two identical bayonet slots, offset by 180°.

The invention is illustrated here with a one level push-piece 2. It is naturally possible to manufacture a similar mechanism, with a longer linear travel, in the form of a multi-level push-piece, these levels being internal and coaxial with each other, and each comprising return means that tend towards maximum elongation.

More particularly, winding device 1 forms a module which is independent of stem 300 and which is arranged to be fixed to case 200.

The invention also concerns a timepiece movement 600 comprising such a structure 700, on which is fixed at least one winding device 1 according to the invention.

Push-piece 2 is devised to be housed anywhere inside the watch. For example, the Figures illustrate a push-piece 2 which is located substantially at 8 o'clock, which explains the requirement for a reverser pinion 47 for driving the ratchet-wheel in the right direction. This reverser pinion would not be necessary in another configuration, for example with push-piece 2 substantially at 4 o'clock. Thus, the invention allows push-piece 2 to be placed at location with available space, which is advantageous.

In a particular embodiment, with a movement of 13.2 mm width, the rack travel is 2.7 mm. Push-piece 2 must be adapted to this long travel of the rack. Preferably, the travels of the push-piece and the rack are close, or even identical. The locking position must be in the push-piece and not in the mechanism, since, unlike an ordinary push-piece, the stop must be made in the push-piece, in order to access the bayonet recess. This is to take best advantage of the available space. If the width of the movement were 20 mm and not 13.2 mm, much longer travels could be obtained. The invention makes good use of a rectangular movement, which offers a large amount of available space once we are offset of the stem, throughout the width of the movement. In this particular case, the travel of head 7 of push-piece 2 is 2.7 mm, the idle travel of screw 80 before touching rack 4 at start of travel is 0.1 mm, the available travel between the stops of the rack on supports 41 is 2.7 mm, and the useful travel of the rack for winding the barrel is 2.6 mm, due to the 0.1 mm of the push-piece's travel which is dedicated to the safety of the rack, between the end of travel and the stop position of the rack.

The invention advantageously implements only three return means: first elastic return means 6 (spring 31) which tend to move head 7 away from pipe 21, second return means 5 which return the rack, and the third elastic return means cooperating with transmission wheel 46 or with ratchet-wheel 400, which may be formed by spring 480 of click 48 in the non-limiting variant illustrated by the Figures. The product is generally ergonomic, with a retractable push-piece, which has the advantage of having a long, but invisible travel. The user is not inconvenienced when the push-piece is concealed. The return force of the rack must be as low as possible, designed to overcome passive friction. The same principle applies to the push-piece. The return forces of these first and second return means are similar and of the same type, with no special importance as regards operation of the product, the essential point being that each can overcome any possible jamming of the components of the mechanism that it moves.

The invention further concerns a watch 100, especially a mechanical watch, comprising a case 200 containing at least one barrel 300 provided with a ratchet-wheel 400, and a stem 500, movable with respect to case 200, for controlling at least the time setting function, watch 100 comprising such a structure 700, to which is fixed a winding device 1 according to the invention, or comprising such a movement 600, and said case 200 comprises at least one chamber 201 for housing a push-piece 2, which is remote from stem 500.

What is claimed is:

1. A winding device arranged to be secured to a structure of a watch comprising a case containing at least one barrel, a stem, movable with respect to said case, for controlling at least the hand-setting function, said winding device comprising a retractable bayonet push-piece which is telescopically extendable, comprising, between a pipe arranged to be fixed to said case and a user-actuatable head which carries a control member, first elastic return means tending to move said head away from said pipe, said head being movable in translation with respect to the longitudinal axis of said pipe, between two extreme end positions, which are a stop position, wherein said head is as close as possible to said case, and wherein said stop position said head has one rotational degree of freedom with respect to the longitudinal axis of said pipe, and an activated position which is a position of maximum elongation, accessible to the user, and wherein said head is indexed in rotation with respect to said case in an indexed angular position, said head being capable of occupying, between said two stop and activated positions, a rest position wherein said head is capable of being immobilised longitudinally with respect to said pipe, in at least one angular locking position which is different from said indexed angular position, said push-piece, which is independent of said stem, being dedicated exclusively to the winding function and being arranged to indirectly drive at least the drum of said at least one barrel or a ratchet-wheel in order to wind said at least one barrel, said control member being movable linearly and arranged, upon a user action, for driving at least one movable rack against second elastic return means, wherein said at least one rack is slidably mounted and guided by guide means or by at least two supports, and cooperates with a winding wheel set which meshes with an intermediate rack actuated by at least one return spring comprised in said second elastic return means.

2. The winding device according to claim 1, wherein said winding wheel set meshes with a sliding intermediate wheel which, depending upon its direction of rotation, meshes or does not mesh with said ratchet-wheel, or with a transmission wheel meshing with said ratchet-wheel, or with the drum of said barrel, for winding said barrel as a result of actuation of said push-piece.

3. The winding device according to claim 2, wherein said winding wheel set meshes with a sliding intermediate wheel via at least one reverser pinion.

4. The winding device according to claim 2, wherein said winding device comprises a third elastic return means, or a click, cooperating with said transmission wheel or with said ratchet-wheel.

5. The winding device according to claim 1, wherein said rack is linearly movable, and wherein said head is movable on a first linear travel, which is parallel to a second linear travel on which said rack is movable.

6. The winding device according to claim 1, wherein said winding device forms a module independent of said stem and which is arranged to be fixed to said case.

7. The winding device according to claim 1, wherein said pipe comprises a first bore for guiding an arbor which is fixed to said head and which forms said control device for pushing a rack or a moving timepiece component.

8. The winding device according to claim 1, wherein said push-piece forms an independent module.

9. The winding device according to claim 1, wherein said pipe comprises, adjacent to a thrust collar, a cylindrical shoulder on which slides a bore of said head and inside which is provided at least one longitudinal slot parallel to its axis and inside which slides a lug integral with a front end of said head, said at least one longitudinal slot leading, in proximity to said collar, into a recess forming a bayonet profile capable of receiving said lug upon suitable rotation of said head with respect to said pipe, to form an axial stop for said head with respect to said pipe.

10. The winding device according to claim 9, wherein said pipe comprises a first chamber aligned with a second chamber comprised in said head for reception of a spring tending to move said head away from said pipe, said spring forming said first elastic return means, and wherein said recess comprises a housing arranged to house said lug in a rest position, and which is separated from said longitudinal slot by a peripheral stop preventing any rotation of said head, when said lug is housed inside said housing in the absence of axial movement by said head.

11. The winding device according to claim 1, wherein said pipe comprises a first chamber aligned with a second chamber comprised in said head for reception of a spring tending to move said head away from said pipe, said spring forming said first elastic return means.

12. A timepiece movement including a structure on which is fixed at least one winding device according to claim 1.

13. A watch comprising said case containing said at least one barrel, and said stem, movable with respect to said case, for controlling at least the time-setting function, said watch comprising said structure to which is fixed said winding device according to claim 1, and said case comprising at least one chamber for housing said push-piece, which is remote from said stem.

14. The watch according to claim 13, wherein said watch is a mechanical watch.

* * * * *